US006560879B2

(12) United States Patent
Franke et al.

(10) Patent No.: US 6,560,879 B2
(45) Date of Patent: May 13, 2003

(54) CHAIN SAW ADJUSTER

(75) Inventors: Jeff Franke, Texarkana, TX (US); Paul Warfel, Texarkana, TX (US); Rodney Tynes, Shreveport, LA (US)

(73) Assignee: WCI Outdoor Products, Inc., Cleveland, OH (US)

( * ) Notice: Subject to any disclaimer, the term of this patent is extended or adjusted under 35 U.S.C. 154(b) by 0 days.

(21) Appl. No.: 09/921,075

(22) Filed: Aug. 2, 2001

(65) Prior Publication Data

US 2003/0024129 A1 Feb. 6, 2003

(51) Int. Cl.[7] ..... B27B 17/14
(52) U.S. Cl. ..... 30/386; 30/383
(58) Field of Search ..... 30/383, 385, 386, 30/381

(56) References Cited

U.S. PATENT DOCUMENTS

| | | | | | |
|---|---|---|---|---|---|
| 536,323 | A | | 3/1895 | Bach | |
| 2,032,609 | A | | 3/1936 | Arsneau | |
| 2,444,138 | A | | 6/1948 | Mall | |
| 2,618,298 | A | | 11/1952 | Pratt | |
| 2,624,379 | A | | 1/1953 | Arneson | |
| 2,765,821 | A | | 10/1956 | Strunk | |
| 2,767,746 | A | | 10/1956 | Adams | |
| 2,839,097 | A | | 6/1958 | Siria | |
| 2,910,099 | A | | 10/1959 | Mall | |
| 3,194,284 | A | * | 7/1965 | Walker | 30/386 |
| 3,267,973 | A | * | 8/1966 | Beard | 30/386 |
| 3,421,724 | A | | 1/1969 | Cornell | 248/23 |
| 3,596,689 | A | | 8/1971 | Oehrli | 143/32 |
| 3,636,995 | A | * | 1/1972 | Newman | 30/386 |
| 3,866,320 | A | | 2/1975 | Progl | 30/386 |
| 3,872,801 | A | | 3/1975 | Weddendorf | 108/20 |
| 4,129,943 | A | * | 12/1978 | Bricker | 30/386 |
| 4,315,370 | A | | 2/1982 | Horne | 30/386 |
| 4,316,327 | A | | 2/1982 | Scott et al. | 30/386 |
| 4,567,658 | A | | 2/1986 | Wissmann et al. | 30/386 |
| 4,583,961 | A | | 4/1986 | Kawasawa et al. | 474/113 |
| 4,618,336 | A | | 10/1986 | Isobe et al. | 474/133 |
| 4,776,826 | A | * | 10/1988 | Scott | 30/381 |
| 4,835,868 | A | | 6/1989 | Nagashima | 30/386 |
| 4,920,650 | A | | 5/1990 | Edlund | 30/386 |
| 4,999,918 | A | | 3/1991 | Schliemann et al. | 30/386 |
| 5,070,618 | A | | 12/1991 | Edlund | 30/386 |
| 5,144,751 | A | | 9/1992 | Weber | 30/386 |
| 5,174,029 | A | | 12/1992 | Talberg | 30/386 |
| 5,177,871 | A | | 1/1993 | Martenson | 30/122 |
| 5,249,362 | A | | 10/1993 | Harding | 30/383 |
| 5,277,667 | A | | 1/1994 | Gardner et al. | |
| 5,342,249 | A | | 8/1994 | Gardner et al. | |
| 5,345,686 | A | | 9/1994 | Zimmermann | 30/386 |
| 5,353,506 | A | | 10/1994 | Muller et al. | 30/386 |
| 5,370,586 | A | | 12/1994 | Thomsen et al. | |
| 5,421,787 | A | | 6/1995 | Ellis | 474/101 |
| 5,491,899 | A | | 2/1996 | Schliemann et al. | 30/386 |
| 5,497,557 | A | | 3/1996 | Martinsson | 30/386 |
| 5,522,143 | A | | 6/1996 | Schliemann et al. | 30/386 |
| 5,528,835 | A | | 6/1996 | Ra | 30/386 |
| 5,533,432 | A | | 7/1996 | Örnberg | 30/386 |
| 5,709,254 | A | | 1/1998 | Argue | 30/386 |
| 5,862,600 | A | | 1/1999 | Leini et al. | 30/386 |
| 5,896,670 | A | * | 4/1999 | Gibson et al. | 30/386 |
| 5,960,549 | A | | 10/1999 | Höppner | 30/381 |
| 5,983,508 | A | | 11/1999 | Sundstrom | 30/386 |
| 6,016,604 | A | | 1/2000 | Wolf et al. | 30/383 |
| 6,032,373 | A | | 3/2000 | Peterson | 30/386 |
| 6,237,228 | B1 | * | 5/2001 | Moody | 30/381 |
| 6,473,975 | B1 | | 11/2002 | Sellman | 30/386 |

* cited by examiner

*Primary Examiner*—Hwei-Siu Payer
(74) *Attorney, Agent, or Firm*—Pearne & Gordon LLP

(57) ABSTRACT

An arrangement that provides a semi-automatic tension adjustment of an endless cutting chain on a guide bar of a chain saw as the links of the chain wear with use. A specially designed cam biases a tensioner pin to continuously force the guide bar away from the drive sprocket on the engine chassis to tension the chain. A knob on a clutch cover assembly attached to the engine chassis can be tightened to force two high friction surfaces together to lock the guide bar in a tensioned position, or loosed to release the guide bar to seek a proper tensioned position. An override lever on the face of the clutch cover assembly moves in a channel with peripheral nomenclature that indicates when the cutting chain should be replaced. The entire arrangement is self-contained and does not require any tools to function.

25 Claims, 5 Drawing Sheets

CHAIN SAW ADJUSTER

BACKGROUND OF THE INVENTION

The invention relates to an arrangement that facilitates periodic tensioning of an endless cutting chain on a guide bar of a chain saw.

PRIOR ART

As the links in the cutting chain of a chain saw wear with use, the chain stretches and becomes loose on the guide bar. Many methods exist to move the guide bar longitudinally away from the chain saw body and drive sprocket to take the slack out of the links of the cutting chain to ensure that the links of the chain remain seated in and ride in a peripheral channel in the guide bar. A number of methods require the operator to physically move the guide bar longitudinally from the chassis to a tensioned position and then employ a tool or tools to physically tighten the assembly so that the bar will remain in the new position. In other methods, tightening screws, hydraulic pistons and other devices for moving the bar to its new position are employed and again the assembly is tightened, in many cases employing a tool or tools to ensure that the bar remains in the new position.

The purpose of the invention is to provide an arrangement that will enable the chain guide bar to move outwardly to the tensioned position automatically when the locking friction on the bar is relieved and to remain in the new position once the bar is tightened without the use of a tool or tools. Additionally, the invention can provide an indication to the chain saw operator when the chain should be replaced.

SUMMARY OF THE INVENTION

The invention provides a means of automatic tension adjustment of an endless cutting chain on a guide bar of a chain saw as the chain links expand with wear, without requiring the use of any tools to make the adjustment.

In accordance with the invention, the chain saw comprises, besides an engine body or chassis, a guide bar with an endless cutting chain, and a clutch cover assembly. The engine drives a chain drive sprocket. The guide bar is aligned in a horizontal position relative to the engine chassis, forward of the chain drive sprocket, by two studs affixed to and projecting perpendicularly from the side of the engine chassis. The guide bar is located in a manner to allow the drive sprocket to engage the links of the cutting chain. The studs are specifically located adjacent to each other in a horizontal plane and extend through a horizontal slot in the guide bar. The guide bar is of an elongated plate configuration that provides a channel around its periphery in which the links of the endless chain ride. A tensioner pin affixed to the guide bar and extending perpendicularly from it provides a surface that is engaged by a spring biased cam. The cam operates through the tensioner pin to continuously apply a force on the bar away from the drive sprocket. A locking plate with a slot coinciding with the slot in the guide bar is precisely located on the guide bar by tabs that project perpendicularly from the locking plate and extend through the slot in the guide bar. A hole in the locking plate aligns with the position of the tensioner pin on the guide bar and allows the tensioner pin to extend through the locking plate. An elongated high friction surface is coined or otherwise formed on the locking plate above the slot. When assembled, the high friction surface on the locking plate mirrors the location of a similar high friction surface coined or otherwise formed on a cover plate. The cover plate is attached to the clutch cover assembly by a machine screw and located in position to mirror the locking plate by locator pins molded on the inner face of the clutch cover assembly.

The clutch cover assembly is a housing molded or otherwise formed of a suitable material such as plastic or die cast metal that is attached to the chain saw motor body by a knob. The knob, having an internally threaded nut insert, is threaded onto the forward alignment stud affixed to the motor chassis and extending perpendicularly from it. The clutch cover assembly provides an internal molded cavity to house the tension spring that continuously biases the cam against the tensioner pin on the guide bar. The cam profile has a unique function of ensuring that the principle force vector applied to the tensioner pin is generally horizontal for improved automatic adjustment operation. Additionally, the cam configuration ensures that the cam is in a proper location before the clutch cover assembly can be fully seated and before the knob can be threaded onto the alignment stud. The cam is attached to a pivot pin on an override lever that extends through the clutch cover assembly. The override lever is fixed to the pivot pin externally of the clutch cover and rides in a channel molded on the outer face of the clutch cover assembly. As the override lever is directly attached to the cam, it follows the movement of the guide bar as it takes the slack out of, i.e. tensions, the cutting chain. Nomenclature embossed or otherwise labeled on the side of the override lever channel indicate to the operator when the cutting chain has reached its full extension and should be replaced.

The knob on the clutch cover assembly, when turned clockwise, allows the operator to tighten the cover plate high friction surface onto the locking plate high friction surface to lock the guide bar in proper operating position. Alternatively, when turned counter-clockwise, the knob releases the two friction surfaces to allow the spring operated cam to again move the guide bar forward towards its full extension and take any slack out of the links of the endless cutting chain. A knob lever that can be easily raised to a perpendicular position relative to the knob face provides an easily gripped element for forcibly turning to the knob.

DESCRIPTION OF THE PREFERRED EMBODIMENT

Figure 1:
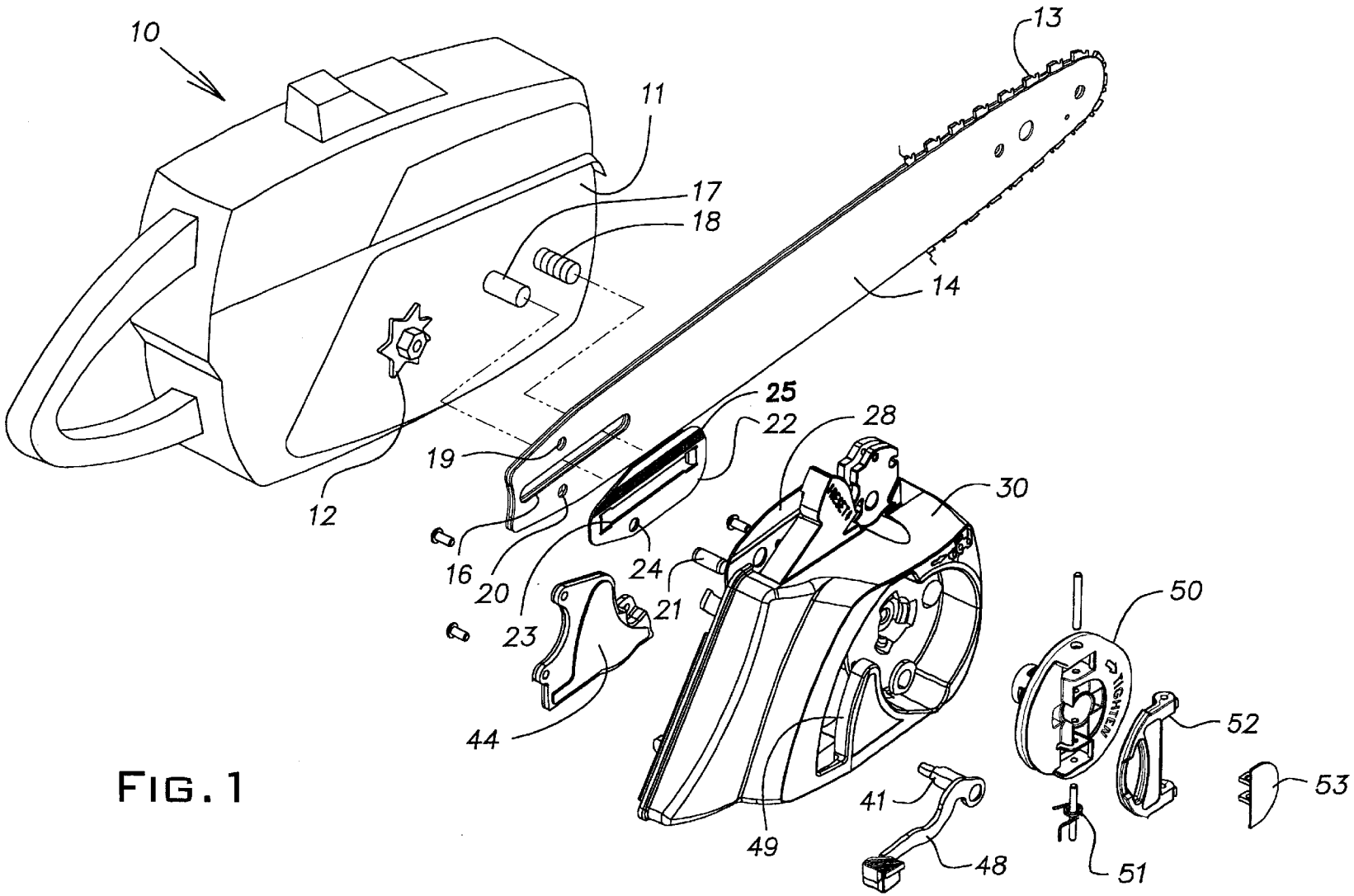
FIG. 1 is an exploded isometric view of parts of a chain saw embodying the invention.
Figure 2:
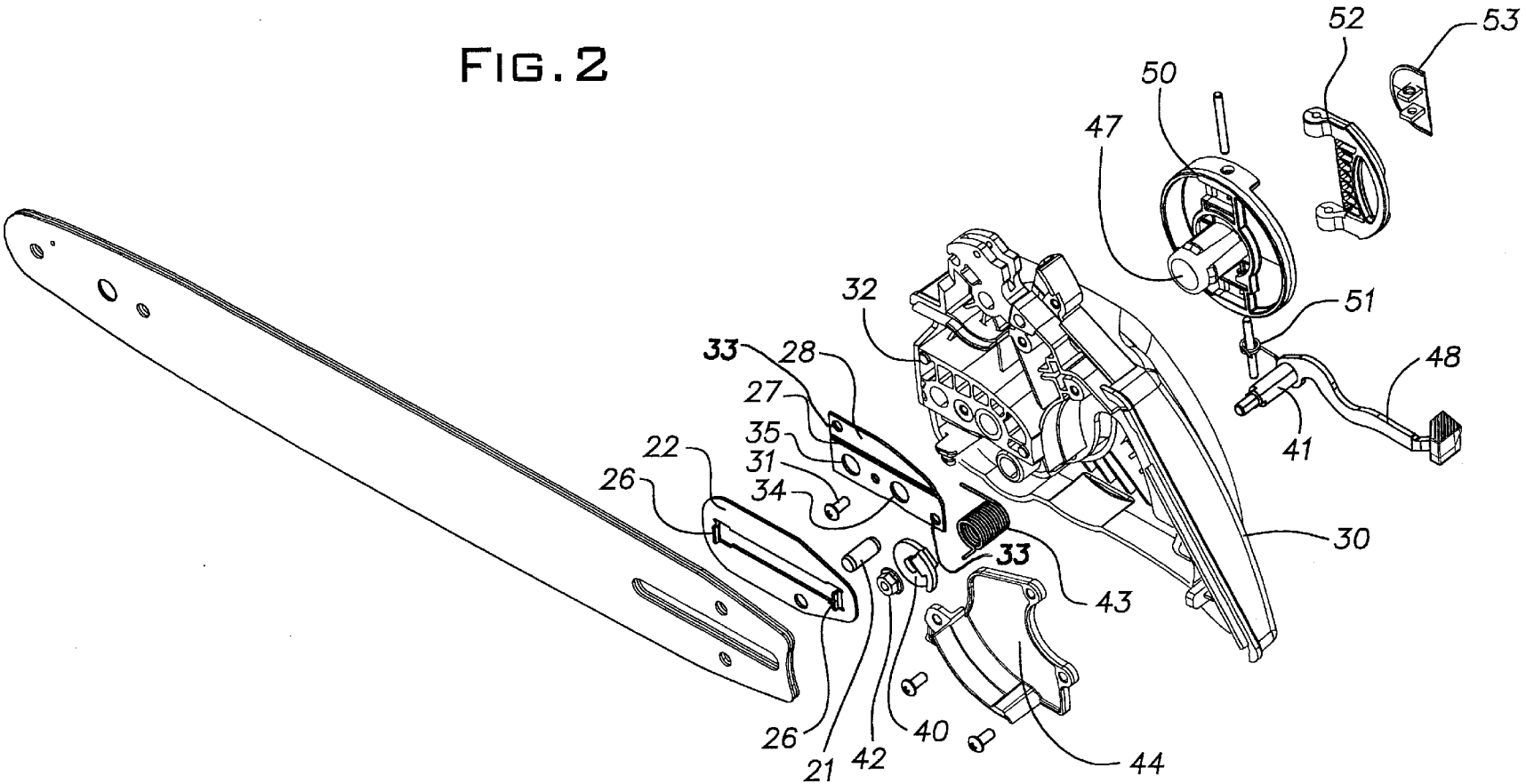
FIG. 2 is an exploded isometric view of the chain saw parts from a side opposite that of FIG. 1.

FIGS. 1 and 2 illustrate a chain saw 10 incorporating an automatic chain tensioner of the present invention. The saw 10 has an engine chassis or body 11 which incorporates a conventional engine as known in the art which turns a drive sprocket 12 attached to the drive shaft of the engine. The drive sprocket 12 engages the links of an endless cutting chain 13 and propels it around a guide bar 14. The guide bar, as known in the art, is of an elongated plate configuration with a channel or groove 15 around its periphery and an idler sprocket (not shown) at its distal end into which the links of the cutting chain 13 ride. Parallel pins or studs 17 and 18 affixed to the engine chassis lie in a common generally horizontal plane and extend perpendicularly through an elongated horizontal slot 16 in the guide bar 14 with a sliding fit. The studs 17, 18, align the guide bar 14 to the engine body 11 and, since the spacing between the studs is considerably less than the length of the slot 16, the guide bar is able to slide horizontally on the studs for the purpose of chain adjustment as described below. A clutch cover assembly 30, of a molded plastic or a die case metal material, provides a housing for components that lock and unlock the movement of the guide bar 14 for purposes of adjustment the chain 13. The clutch cover assembly 30 is removably attached to the forward stud 18. The forward stud 18 on the engine chassis 11 is externally threaded. Raised nodules or pins molded on the inner facing of the clutch cover assembly 30 match mirrored slots cut or otherwise made in the engine chassis 11 to locate the clutch cover assembly 30 on the chassis 11.

The elongated horizontal slot 16 in the guide bar 14 allows the guide bar to be moved away from the drive sprocket 12 along the horizontal axis defined by the location of the studs 17 and 18. This movement of the guide bar 14 takes up slack that occurs in the chain from wear. The guide bar 14 has a hole 19 located above the horizontal slot 16 that allows oil from an oiler (not shown) on the engine chassis 11 to provide lubrication to the bar 14 and cutting chain 13 when the chain saw 10 is in operation. Located below the slot 16 is a second hole 20 into which a cylindrical tensioner pin 21, extending perpendicularly from the plane of the guide bar 14, is pressed or otherwise fixed, preferably permanently. The pin 21 projects beyond the guide bar 14 by a distance at least equal to the thickness of the guide bar and preferably about at least twice the thickness of the guide bar.

A locking plate 22 that has a slot 23 mirroring or coinciding with the slot 16 and a hole 24 aligned over the tensioner pin 21 is located on the guide bar 14 (at a side from which the tensioner pin principally projects) by tabs 26 folded through the slot 16. An elongated high friction surface 25 is coined or otherwise formed above the slot 16 on the side of the locking plate 22 facing towards the clutch cover assembly 30. The friction surface 25 is preferably characterized by a series of relatively small vertical ridges of triangular cross-section coined into the plate 22. For example, the ridge cross-sections can approach the form of contiguous equilateral triangles with side dimensions of approximately 0.5 mm.

A cover plate 28 secured to a clutch cover assembly 30 by a machine screw 31 is positioned to mirror or overlie the position of the locking plate 22 by molded locator pins 32 that extend into locator holes 33 in the cover plate. Holes 34 and 35 in the cover plate are aligned with and assembled over the studs 17 and 18 on the engine chassis 11 to fix the cover plate relative to the chassis. An elongated high friction surface 27 mirroring and complementary in shape to the high friction surface 25 on the locking plate 22 is coined or otherwise formed on the side of the cover plate 28 facing away from the clutch cover assembly 30. The friction surface 27 is preferably characterized by a series of small vertical ridges complimentary to the ridges of the mating surface 25.

Figure 3:
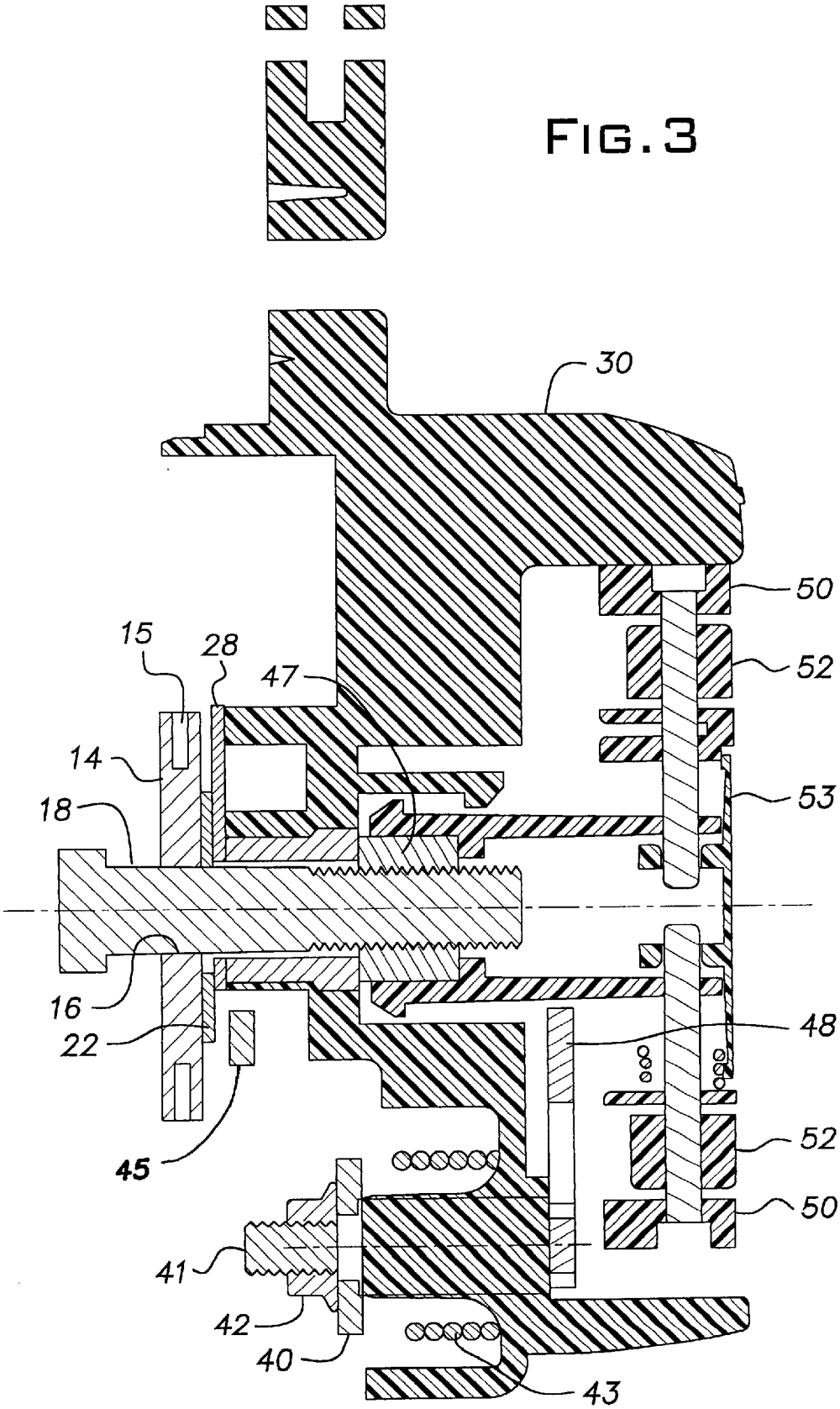
FIG. 3 is a cross-sectional view of assembled parts of the chain saw taken in a vertical plane passing through the center of a forward stud affixed to the motor chassis.
Figure 4:
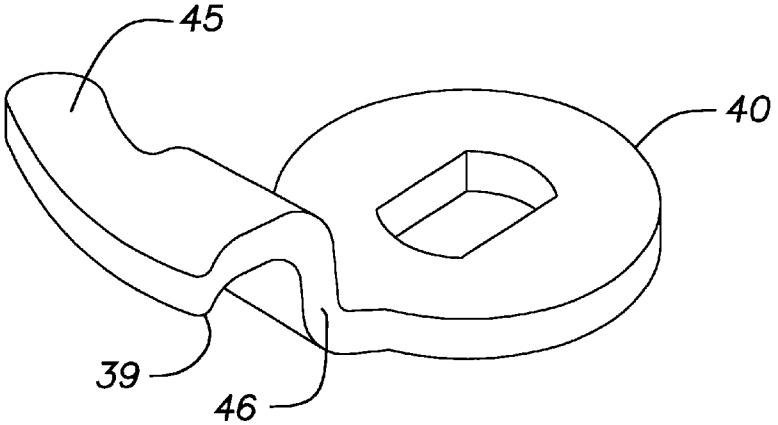
FIG. 4 is an isometric view of the specially designed chain tensioner cam or lever.

A specially designed cam or short pivotal lever 40 as shown in FIG. 4 is attached to a pivot pin 41 extending through the clutch cover assembly 30 by a hex flange locking nut 42; the cam 40 (FIGS. 5*a*–5*c*) is rotationally locked to the pivot pin 41. The cam 40 is continuously biased against the tensioner pin 21 by a torsion spring 43 (FIG. 3). The spring 43 is located in a molded cavity in the clutch cover assembly 30.

An override lever 48, staked or otherwise rigidly attached to an outer end of the pivot pin 41 and located in a molded override channel 49 on the external face of the clutch cover assembly 30, directly follows the angular movement of the cam 40 as it biases the tensioner pin 21 forcing the guide bar 14 outward to tension the cutting chain 13. Nomenclature, embossed or otherwise attached along the side of the override channel, to which the free end of the lever 48 points, can indicate to the operator when the cutting chain should be replaced. A knob insert 47 molded in a knob 50 is internally threaded. The knob insert or nut 47 is threaded onto the forward stud 18 affixed to the engine body 11. A knob handle 52 that can be pivotally raised perpendicular to the knob 50 provides a finger grip, which has a dimension about as large as the width of the guide bar 14 for forcibly but easily turning the knob without tools. It will be seen that the cover plate 28, cam 40, pivot pin 41, lever 48 and knob 50 are all assembled and supported by the clutch cover 30.

When the knob 50 is turned clockwise, it tightens the elongated friction surface 27 on the cover plate 28 onto the friction surface 25 on the locking plate. When these two surfaces are forced together, the tensioner pin 21 is locked in its present position and cannot move forward keeping the guide bar in its present position. When the knob 50 is turned counter-clockwise sufficiently to release the pressure of the friction surfaces, the spring biased cam 40 forces the guide bar forward to tension the cutting chain 13. When the knob 50 is fully turned counter-clockwise, the clutch cover assembly 30 can be removed from the engine chassis 11. Usually this is done only to replace an endless cutting chain 13. When the clutch cover assembly 30 is removed from the engine chassis 11, the specially designed spring tensioned cam 40 is released from the tensioner pin 21 and springs to its most extended position (clockwise in FIGS. 5*a*–5*c*). The trailing section 45 of the specially designed cam 40 overlies the end of the tensioner pin 21 on the guide bar if the cam is not first angularly retracted by manually moving the override lever 48 counter-clockwise against the force of the spring 43 and thereby prevents installation of the clutch cover until the cam is on the proper rearward side of the tension pin. When the clutch cover assembly 30 is again assembled onto the engine chassis 11, and the override lever 48 is released, the spring tensioned cam 40 again biases the tensioner pin 21 moving the guide bar 14 to its fully tensioned position.

Figure 5C:
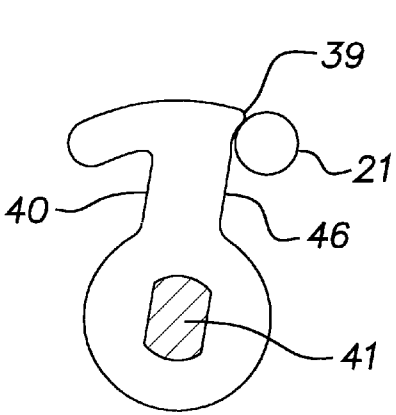
FIGS. 5*a*, 5*b* and 5*c* are a somewhat schematic progressive series of positions, in an elevational view, of the chain tensioner cam as it bears against the tensioner pin on the guide bar and the cutting chain becomes longer through use.
Figure 5B:
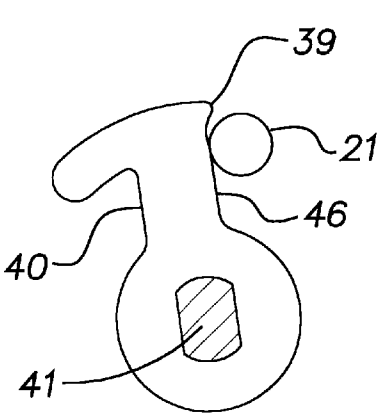
Figure 5A:
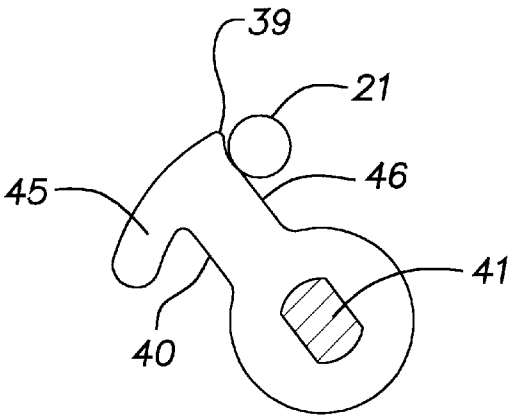
Figure 6:
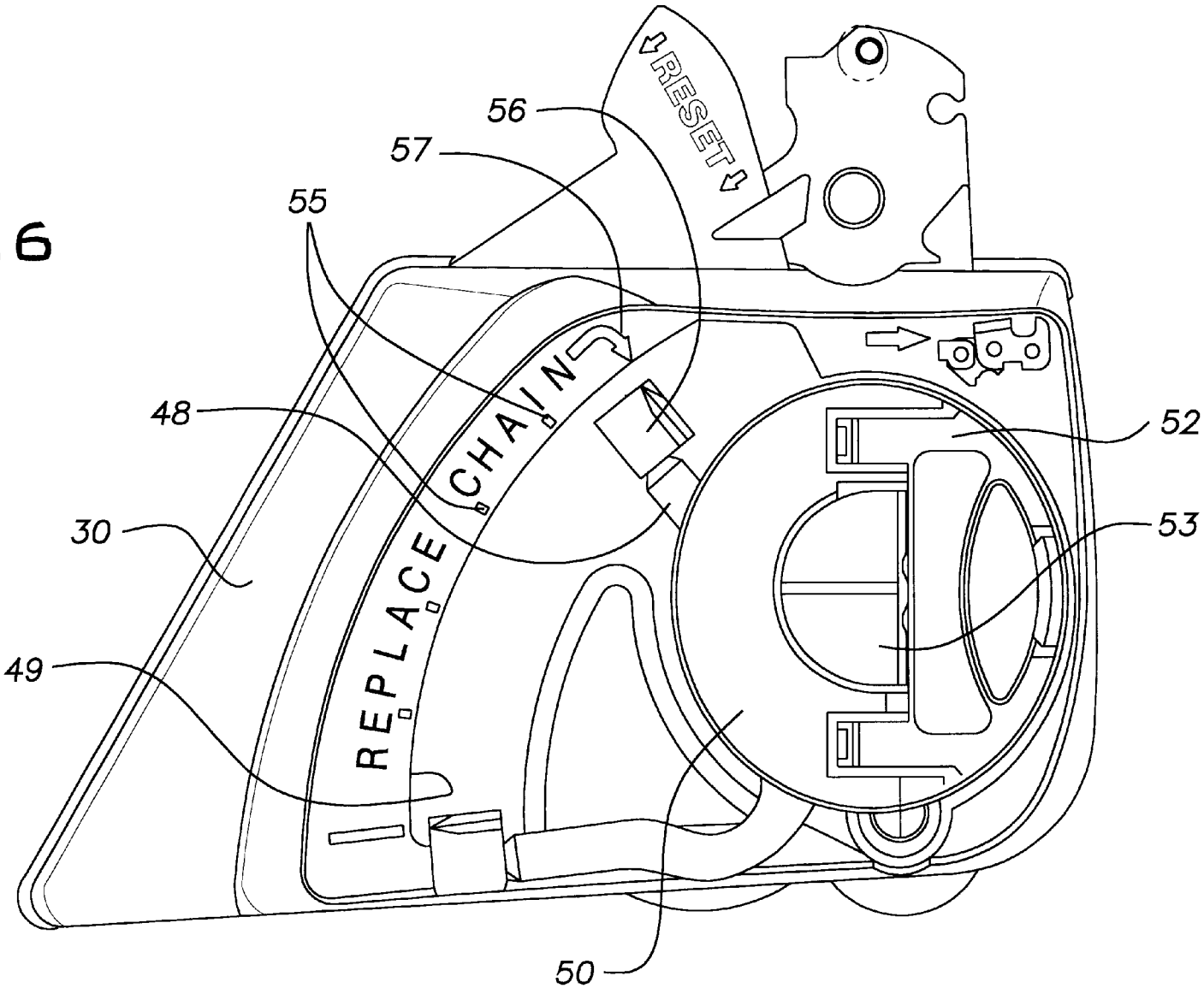
FIG. 6 is a side view of a clutch cover assembly and override lever.

In use, the operator ensures that the knob 50 is fully turned clockwise and the clutch cover assembly 30 is tightened onto the engine chassis 11. As the chain saw is used over a period of time, the links of the chain wear at their pin joints and the length of the chain increases. When the operator observes excessive slack in the chain, he or she raises the knob handle 53 and turns the knob 50 counter-clockwise backing the clutch cover assembly 30 slightly off of the engine chassis 11. With this action, the friction surface 27 on the cover plate is released from the friction surface 25 on the locking plate 22. The tension spring 43 biases the working edge surface 46 of the cam 40 against the tensioner pin 21, forcing the guide bar 14 away from the drive sprocket to tension the cutting chain 13. The location of the pin 21 beneath the studs 17, 18 enables the force applied by the cam 40 to assist in overcoming the moment developed by the overhanging weight of the guide bar 14 and chain 13 to assist in smooth tensioning movement. Once the cutting chain 13 has been tensioned, the operator tightens the knob 50 forcing the friction surfaces of locking plate 24 and cover plate 28 together to lock the guide bar in the extended tension adjusted position. The override lever 48, directly attached to the spring biased cam 40, moves upward in the override channel 49 to a new position along indicia 55 (FIG. 6) indicating the chain extension. As the links in the cutting chain 13 expand with additional extended use, and the operator desires to again take the slack out of the cutting chain, the process is repeated. FIGS. 5*a*–5*c* illustrate successive positions of the tensioner cam 40 as the cutting chain experiences wear. FIG. 5*a* represents the position of the cam 40 when the chain is new. The cam 40, formed as a stamping of sheet metal, has a working edge surface 46 with a profile that advantageously operates to keep the force it applies to the pin 21 generally in the longitudinal direction of the guide bar 14. A rise area 39 on the cam profile achieves this result. FIG. 5*b* shows the cam 40 in a mid-position while FIG. 5*c* shows the cam in a position where the chain has reached the end of its useful life. As suggested in FIG. 6, this condition can be indicated when a knob 56 on the override lever 48 reaches the indicia legend "REPLACE CHAIN" and an arrow 57. The indicia 55, 57 can be molded into the clutch cover assembly 30 or otherwise be provided by paint, ink, decal, or the like.

When the override lever 48 reaches a near vertical position in the override channel 49, the nomenclature indicates that the chain should be replaced. The operator moves the override lever 48 to its near horizontal position releasing the cam 40 from the tensioner pin 21 and turns the knob 50 fully counter-clockwise to remove the clutch cover assembly 30 from the motor chassis 11 and thereby make the worn chain accessible for its removal.

Once a new endless cutting chain 13 has been installed on the guide bar 14, the clutch cover assembly 30 may be reattached to the engine chassis 11. The operator replaces the clutch cover assembly 30 back onto the engine chassis 11 by turning the knob 50 clockwise to thread the knob insert 47 onto the forward stud 18 on the engine chassis 11. In the event that the spring 43 fails to adequately tighten the chain due to excessive dirt or other adverse conditions, the override lever 48 can be manually pushed to assist the spring. It will be seen that the length of the override lever 48 is several times longer than the effective radius of the cam 40 so that a mechanical advantage is conveniently afforded to the operator.

The invention permits the use of standard mass-produced guide bars modified with the disclosed hardware to maintain the economies of high-volume produced components. It should be noted that this disclosure is by way of example, and that various changes may be made by adding, modifying or eliminating details without departing from the fair spirit and scope of the teaching contained in this disclosure. For example, a friction surface equivalent to the locking plate friction surface 25 can be formed directly on the guide bar 14. The friction surfaces 25 and 27 can be formed with a variety of surface features besides the described vertical ridges. One of the friction surfaces on either the guide bar or the clutch cover can be made relatively smooth but softer than the opposite friction surface.

What is claimed is:

1. A guide bar for a chain saw comprising an elongated planar body having a proximal end and a distal end and a pair of opposed long sides, the distal end having a convex rounded profile around which an endless chain changes direction, the proximal end having a profile that enables it to cooperate with a drive sprocket on a drive shaft of a chain saw, the body having a longitudinally extending slot area with a through-slot adjacent the proximal end, the length of the slot being substantially greater than the width of the slot, the slot area being adapted to receive a pair of parallel studs carried by a chassis of a chain saw, a cam follower rigidly attached to the body and projecting perpendicularly from a planar face of the body, the cam follower being located, in a longitudinal direction, at a position between the ends of the slot area and, in a direction perpendicular to the longitudinal direction, between the slot and one of said long sides, and a high friction surface on the face of the body from which the cam follower projects.

2. A guide bar as set forth in claim 1, wherein the high friction surface is located along the slot.

3. A guide bar as set forth in claim 2, wherein the high friction surface is located between the slot and a long side of the body remote from the cam follower.

4. A guide bar as set forth in claim 3, wherein the cam follower is a cylindrical pin.

5. A guide bar as set forth in claim 4, wherein the slot area has a single longitudinal slot.

6. A guide bar as set forth in claim 5, wherein the friction surface is provided by a plate assembled on the body.

7. A guide bar as set forth in claim 6, wherein the body is symmetrical about an imaginary longitudinal axis.

8. A guide bar as set forth in claim 7, wherein the cylindrical pin is in a first circular hole in the body and the body has a second hole symmetrical about said axis with said circular hole and adapted to receive lubricating oil.

9. A chain saw including a chassis, an elongated guide bar, support surfaces on the chassis for mounting the guide bar on the chassis, the chassis supporting a chain drive sprocket, an endless chain mounted on the guide bar and the sprocket, the support surfaces and the guide bar being arranged to permit limited longitudinal movement of the guide bar relative to the sprocket to adjust the tension in the chain, and a manually operated lever pivotally mounted relative to the chassis, the lever being connected to a surface engageable with a surface fixed to the guide bar, the lever being constructed and arranged to move the guide bar on said support surfaces away from said drive sprocket to tension the chain, high friction surfaces arranged to be squeezed together by a clamp, one of said high friction surfaces being fixed relative to said guide bar and a second of said friction surfaces being fixed relative to said chassis.

10. A chain saw including a chassis, an elongated guide bar, support surfaces on the chassis for mounting the guide bar on the chassis, the chassis supporting a chain drive sprocket, an endless chain mounted on the guide bar and the sprocket, the support surfaces and the guide bar being arranged to permit limited longitudinal movement of the guide bar relative to the sprocket to adjust the tension in the chain, and a manually operated lever pivotally mounted relative to the chassis, the lever being connected to a surface engageable with a surface fixed to the guide bar, the lever being constructed and arranged to move the guide bar on said support surfaces away from said drive sprocket to tension the chain, a cam element rotatably fixed to the lever and a cam follower fixed to the guide bar, rotation of the lever causing a corresponding rotation of the cam element and movement of the guide bar.

11. A chain saw as set forth in claim 10, including high friction surfaces arranged to be squeezed together by a clamp, one of said high friction surfaces being fixed relative to said guide bar and a second of said friction surfaces being fixed relative to said chassis.

12. A chain saw as set forth in claim 10, including a spring arranged to rotate said cam element in a chain tightening direction.

13. A chain saw as set forth in claim 12, including high friction surfaces arranged to be squeezed together by a clamp, one of said high friction surfaces being fixed relative to said guide bar and a second of said friction surfaces being fixed relative to said chassis.

14. A chain saw as set forth in claim 12, comprising manually operated clamping means including a relatively large finger grippable element permitting said guide bar to be locked in a chain tensioned position without tools.

15. A chain saw as set forth in claim 14, including a high friction surface fixed to the guide bar and a high friction surface under control of said clamping means and displaceable in a direction perpendicular to a plane of said guide bar against the high friction surface fixed to said guide bar.

16. A chain saw including a chassis, an elongated guide bar, support surfaces on the chassis for mounting the guide bar on the chassis, the chassis supporting a chain drive sprocket, an endless cutting chain mounted on the guide bar and the sprocket, the support surfaces and the guide bar being arranged to permit limited longitudinal movement of the guide bar relative to the sprocket to adjust the tension in the chain, a spring for resiliently biasing the guide bar away from the sprocket to tension the endless cutting chain, a clamp for locking the guide bar in a position determined by the spring prior to operation of the saw, the clamp having a finger grip surface extending over an area having a significant length to enable the clamp to be secured without the use of tools.

17. A chain saw as set forth in claim 1, including high friction surfaces arranged to be squeezed together by said clamp, one of said high friction surfaces being fixed relative to said guide bar and a second of said friction surfaces being fixed relative to said chassis.

18. A chain saw as set forth in claim 1, including a rotary cam operated by said spring and a cam follower fixed to said bar, rotation of said cam caused by force exerted by said spring moving said bar away from said sprocket.

19. A chain saw as set forth in claim 18, including high friction surfaces arranged to be squeezed together by said clamp, one of said high friction surfaces being fixed relative to said guide bar and a second of said friction surfaces being fixed relative to said chassis.

20. A chain saw as set forth in claim 18, including a manually operated lever rotationally locked to said cam, said lever having a length that affords a mechanical advantage when said lever is manually rotated to rotate said cam.

21. A chain saw as set forth in claim 20, including high friction surfaces arranged to be squeezed together by said clamp, one of said high friction surfaces being fixed relative to said guide bar and a second of said friction surfaces being fixed relative to said chassis.

22. A chain saw having a chassis on which is carried an endless saw chain, a drive sprocket, and an elongated guide bar, the chain being trained about the sprocket and the guide bar, the guide bar being mounted on the chassis in a manner that allows it to be adjusted longitudinally away from the sprocket to take up slack in the chain due to wear, a member displaceable on the chassis, apart from the guide bar, in relation to the adjusted position of the guide bar, and indicia fixed relative to the chassis cooperating with the member to indicate the condition of wear of the chain.

23. A chain saw according to claim 22, wherein the member includes a lever pivotal relative to the chassis.

24. A chain saw according to claim 23, including a spring for biasing the guide bar away from the sprocket.

25. A chain saw according to claim 24, wherein the lever is arranged to assist a force of the spring to move the guide bar away from the sprocket.

* * * * *

UNITED STATES PATENT AND TRADEMARK OFFICE

CERTIFICATE OF CORRECTION

PATENT NO. : 6,560,879 B2
DATED : May 13, 2003
INVENTOR(S) : Jeff Franke et al.

It is certified that error appears in the above-identified patent and that said Letters Patent is hereby corrected as shown below:

Column 7,
Line 35, please delete “claim 1”, and insert therefor -- claim 16 --.

Column 8,
Line 1, please delete “claim 1”, and insert therefor -- claim 16 --.

Signed and Sealed this

Twenty-third Day of December, 2003

JAMES E. ROGAN
*Director of the United States Patent and Trademark Office*